US011260505B2

(12) United States Patent
Hongquan

(10) Patent No.: US 11,260,505 B2
(45) Date of Patent: Mar. 1, 2022

(54) RATCHETING DRIVER

(71) Applicant: Meridian International Co., Ltd., Shanghai (CN)

(72) Inventor: Zhang Hongquan, Shanghai (CN)

(73) Assignee: MERIDIAN INTERNATIONAL CO., LTD., Shanghai (CN)

( * ) Notice: Subject to any disclaimer, the term of this patent is extended or adjusted under 35 U.S.C. 154(b) by 0 days.

(21) Appl. No.: 14/566,863

(22) Filed: Dec. 11, 2014

(65) Prior Publication Data

US 2015/0209942 A1 Jul. 30, 2015

(30) Foreign Application Priority Data

Jan. 24, 2014 (CN) ..... 201410032786.5

(51) Int. Cl.
*B25B 15/04* (2006.01)
*B25B 17/00* (2006.01)
*B25B 13/46* (2006.01)

(52) U.S. Cl.
CPC ..... *B25B 15/04* (2013.01); *B25B 13/463* (2013.01); *B25B 17/00* (2013.01)

(58) Field of Classification Search
CPC ..... B25B 15/04; B25B 13/463; B25B 17/00
USPC ..... 81/60–63.2
See application file for complete search history.

(56) References Cited

U.S. PATENT DOCUMENTS 832,077 A 10/1906 Pearce
4,137,801 A * 2/1979 Imperio ..... B25B 13/465 81/58.1
5,201,255 A * 4/1993 Gegg ..... B25B 13/465 81/57.29
5,406,866 A 4/1995 Badiali
5,437,212 A * 8/1995 Thompson ..... B25B 15/04 81/63.1
5,535,648 A * 7/1996 Braun ..... B25B 13/462 81/60
5,632,186 A 5/1997 Lin
5,782,147 A * 7/1998 Chaconas ..... B25B 13/463 192/43.1

(Continued)

FOREIGN PATENT DOCUMENTS

CA 2898343 A1 * 7/2014 ..... B25B 17/00
CN 201565885 9/2010

(Continued)

OTHER PUBLICATIONS

M3 Design, Inc., M3 Design Product Teardown Kobalt Double-Drive Screwdriver, M3 Design, Inc. 2013, www.m3design.com.

*Primary Examiner* — Joel D Crandall
(74) *Attorney, Agent, or Firm* — Shuttleworth & Ingersoll, PLC; Jason R. Sytsma

(57) ABSTRACT

A ratcheting driver comprises a driving mechanism combined between a handle and a working end for translating rotary motion from the handle to the working end. A switch engages the driving mechanism to switch the rotational direction of the working end between clockwise rotation and counter-clockwise rotation with an optional locked position that locks the working end. Two pairs of cooperating pawls are provided that are selectively engaged by the switch with one pawl in each of the two pairs of cooperating pawls selectively engaging one of a first ratchet gear and a second ratchet gear. Each pawl in the pair of cooperating pawls are positioned axially apart from each other in alignment with one of the first ratchet gear and the second ratchet gear.

18 Claims, 7 Drawing Sheets

(56) References Cited

U.S. PATENT DOCUMENTS 5,881,609 A 3/1999 Palmer
5,974,915 A * 11/1999 Chou ..... B25B 13/463 192/43.2
6,047,617 A * 4/2000 Chen ..... B25B 15/04 81/58.4
6,070,499 A * 6/2000 Wisbey ..... B25B 13/467 81/57.29
6,250,183 B1 * 6/2001 Chiang ..... B25B 13/468 81/63
6,293,173 B1 9/2001 Rowlay
6,305,248 B1 10/2001 Rowlay
6,330,843 B1 * 12/2001 Lin ..... B25B 15/04 81/62
6,457,386 B1 * 10/2002 Chiang ..... B25B 13/465 81/57.29
6,935,211 B2 * 8/2005 Chen ..... B25B 15/04 81/438
7,055,410 B2 * 6/2006 Hu ..... B25B 15/02 81/60
7,181,996 B1 * 2/2007 Chu ..... B25B 13/465 81/57.29
7,225,708 B2 * 6/2007 Chen ..... B25B 13/463 192/43.2
7,311,186 B2 * 12/2007 Liao ..... B25B 13/463 192/43.2
7,926,391 B2 * 4/2011 Hu ..... B25B 15/04 81/436
8,931,375 B2 * 1/2015 Huang ..... B25B 13/463 81/63.1
9,751,196 B2 * 9/2017 Hu ..... B25B 13/465
9,815,179 B2 * 11/2017 Anderson ..... B25B 13/463
2014/0083259 A1 * 3/2014 Anderson ..... B25B 13/463 81/63.1
2014/0116205 A1 5/2014 Wang

FOREIGN PATENT DOCUMENTS

CN 102059674 5/2011
CN 202292572 7/2012
DE 3705663 8/1995
DE 29616739 11/1996
EP 2586570 5/2013
KR 20100089611 8/2010
WO 2013004045 1/2013

* cited by examiner

RATCHETING DRIVER

This Application claims priority to Chinese App. No. CN201410032786.5 filed on Jan. 24, 2014, the contents of which are incorporated by reference herein.

This disclosure relates to a ratcheting driver, and more particularly, to a bi-acting and reversible ratcheting driver.

BACKGROUND

Tools are often utilized to insert and remove fasteners. Ratcheting drivers include ratcheting mechanisms that enable drivers to apply force to the fastener when the tool is rotated in one direction, but allow the tool to rotate freely without applying a force to the fastener in the opposite direction. Movement of the ratcheting tool in the opposite direction allows the operator to reposition the tool, but otherwise rotation in this direction is wasted motion. Bi-acting drives have been developed to convert this otherwise wasted motion to positive force to the fastener. What these tools need, however, is a reversing mechanism that allows the ratcheting driver to switch directions.

SUMMARY

Disclosed is a ratcheting driver comprising a driving mechanism combined between a handle and a working end for translating rotary motion from the handle to the working end. A switch engages the driving mechanism to switch the rotational direction of the working end between clockwise rotation and counter-clockwise rotation with an optional locked position that locks the working end. Two pairs of cooperating pawls are provided that are selectively engaged by the switch with one pawl in each of the two pairs of cooperating pawls selectively engaging one of a first ratchet gear and a second ratchet gear. Each pawl in the pair of cooperating pawls are positioned axially apart from each other in alignment with one of the first ratchet gear and the second ratchet gear.

In an embodiment, the switch comprises an upper half and a lower half. The upper half of the switch selectively engages one pawl in each of the two pairs of cooperating pawls to selectively urge one of the two pawls into engagement with the first ratchet gear. The lower half of the switch selectively engages one pawl in each of the two pairs of cooperating pawls to selectively urge one of the two pawls into engagement with the second ratchet gear. The inner circumference of the switch has one or more areas that selectively engages the pawls to move the pawls away from the first ratchet gear and the second ratchet gear.

A transmission can be provided for providing unidirectional rotation of the working end with rotation of the handle in both a clockwise direction and a counter-clockwise direction. The transmission comprises a first driving gear positioned coaxially with respect to a second driving gear. The second driving gear is fixed to the second ratchet gear. The first driving gear rotates synchronously with the first ratchet gear. A first primary transmission gear can be positioned between the first driving gear and the second driving gear for rotation about an axis that is perpendicular to the shaft for imparting rotation of the handle to rotation of the working end. A gear rack can be provided for positioning the first driving gear, the second driving gear and the primary transmission gear relative to each other.

These and other features and advantages of the present invention will be better understood by reading the following detailed description, taken together with the drawings.

DETAILED DESCRIPTION OF THE DRAWINGS

Figure 1:
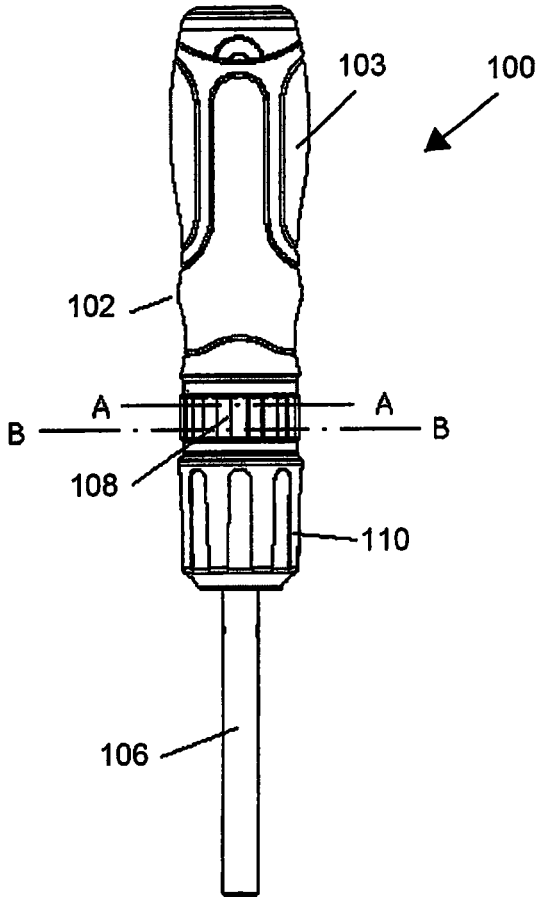
FIG. 1 shows a ratcheting driver according to the disclosure.

FIG. 1 shows a bi-acting and reversible ratcheting driver 100. Bi-acting means that ratcheting driver 100 acts on a work piece while moving the handle of ratcheting driver in both a working direction (clockwise for tightening and counter-clockwise for loosening) and a repositioning direction (counter-clockwise for tightening and clockwise for loosening). In other words, with respect to a working end of ratcheting driver 100, ratcheting driver 100 operates to translate clockwise rotation of the handle (working direction) to clockwise rotation of the working end (working direction) followed by counter-clockwise rotation of the handle (repositioning direction) with continued clockwise rotation of the working end (working direction). This effectively means that ratcheting driver 100 operates at twice the speed because its working end is working while the handle is moved in both the working direction and the repositioning direction.

Ratcheting driver 100 is reversible so that it can be selectively switched between one-way clockwise rotation and counter-clockwise rotation while still bi-acting on the work piece. Converse to the foregoing example, ratcheting driver, when its directional switch has been moved to counter-clockwise rotation, ratcheting driver 100 operates to translate counter-clockwise rotation of the handle (working direction) to counter-clockwise rotation of the working end (working direction) followed by clockwise rotation of the handle (repositioning direction) with continued counter-clockwise rotation of the working end (working direction).

Ratcheting driver 100 includes a handle 102 combined via a driving mechanism 104 (see FIG. 3) to a working end 106. The external components of ratcheting driver 100, shown in FIG. 1, include a gripping portion 103 that when grasped can be rotated in a clockwise or counter-clockwise motion to impart torque and a similar direction of rotation on working end 106. Handle 102 can include a switch 108 to switch ratcheting driver 100 between a clockwise, a counter-clockwise, and a locked position. Housing 110 provides a covering for a transmission 112 that provides the bi-acting motion.

Figure 2:
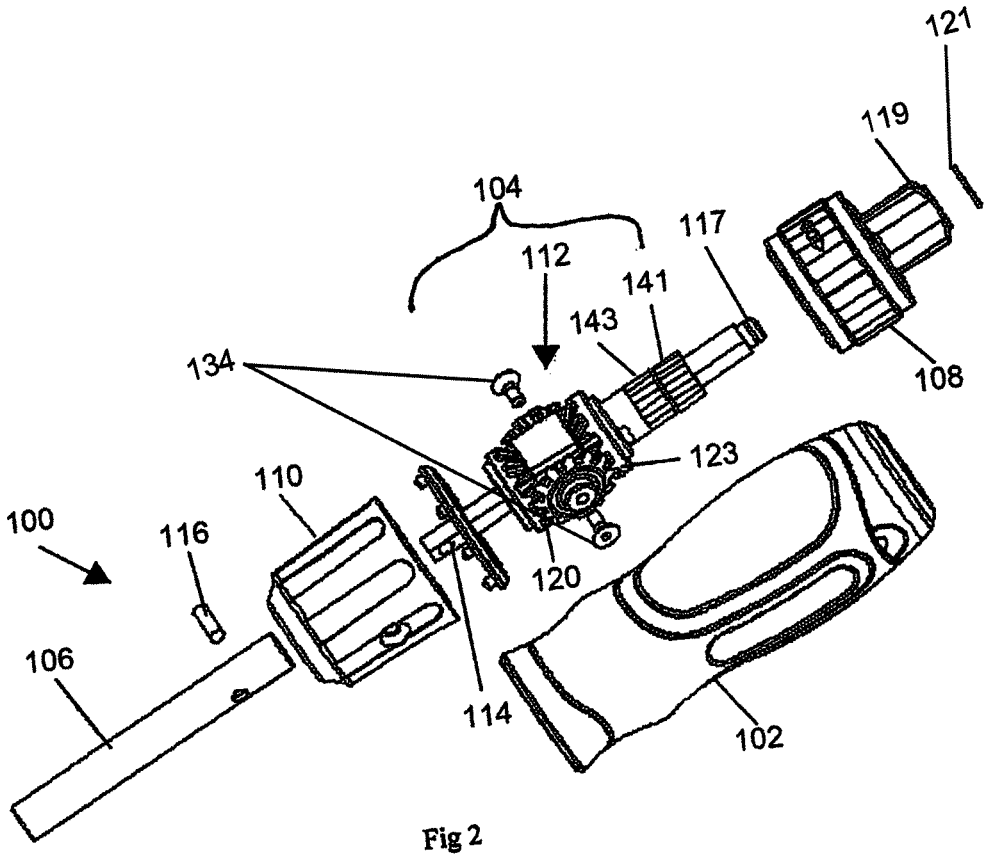
FIG. 2 shows an exploded view of the ratcheting driver of FIG. 1.

FIG. 2 shows an exploded view of ratcheting driver 100. Ratcheting driver 100 includes a shaft 114 that slides into working end 106 where the two are secured together by a pin 116 so that shaft 114 rotates with working end 106. Shaft 114 has an opposite end 117 that is attached to switch 108 by a clip 121. Switch 108 surrounds a pawl cage 150 (both of which are described in more detail below). A spline 119 is attached to the outside of pawl cage 150 for fixing handle 102 to ratcheting driver 100.

Figure 3:
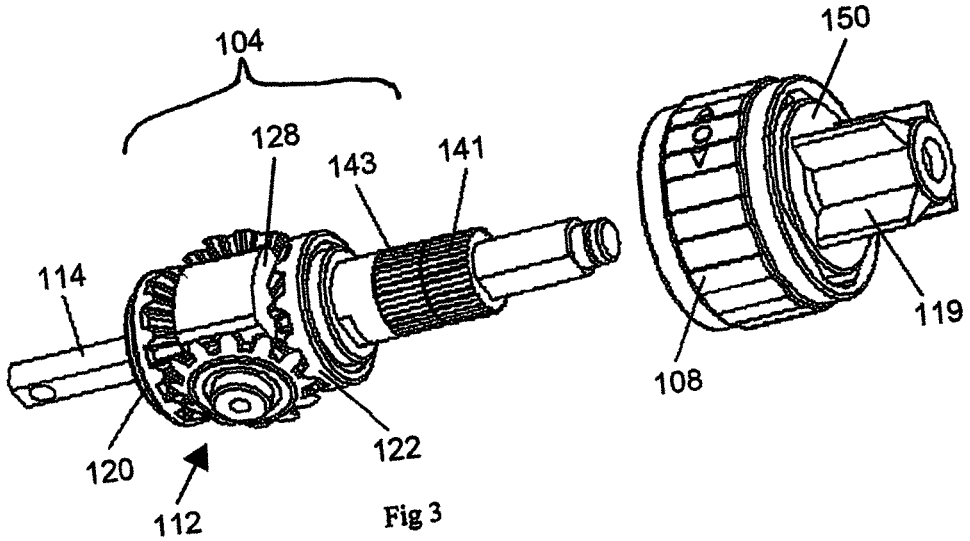
FIG. 3 shows the driving mechanism of the ratcheting driver of FIG. 1.
Figure 4:
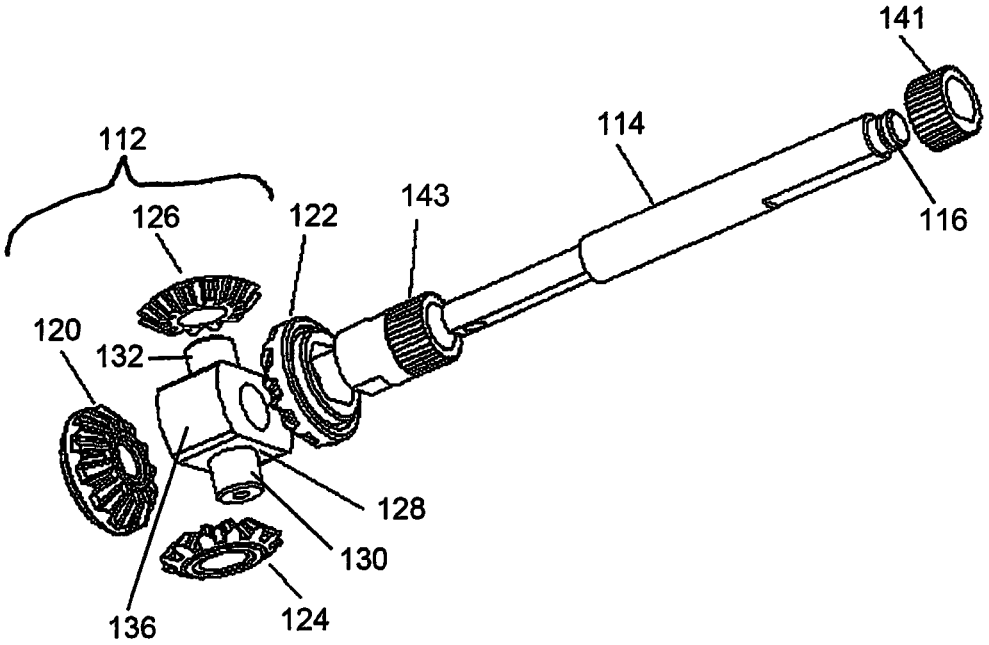
FIG. 4 shows the transmission of the ratcheting driver of FIG. 1.

A transmission 112 is sleeved onto shaft 114. FIGS. 3 and 4 show transmission 112 in greater detail. Transmission 112 includes a first driving gear 120 coaxial with a second driving gear 122 and combined by at least one primary transmission gear 124, so that rotation of one of first driving gear 120 and second driving gear 122 in a first direction causes counter-rotation of the other in the opposite direction. First primary transmission gear 124 rotates about an axis that is perpendicular to the axis defined by shaft 114. In the illustrated embodiment, a second primary transmission gear 126 is provided coaxial with the first primary transmission gear 124 to balance the torque in transmission 112; however, only one primary transmission gear 124 is required.

First primary transmission gear 124 and second primary transmission gear 126 are spaced apart from each other by a gear rack 128 that holds first primary transmission gear 124 and second primary transmission gear 126. Gear rack 128 has a first hub 130 for first primary transmission gear 124 and a second hub 132 for second primary transmission gear 126. First hub 130 and second hub 132 define a second axis defined by fasteners 134 that hold first hub 130 and second hub 132 to gear rack 128 that is perpendicular to a first axis defined by shaft 114. Shaft 114 is sleeved into and extends coaxially with first driving gear 120 and second driving gear 122 and is secured to first driving gear 120 to rotate therewith, while second driving gear 122 rotates freely with respect to shaft 114.

Figure 5:
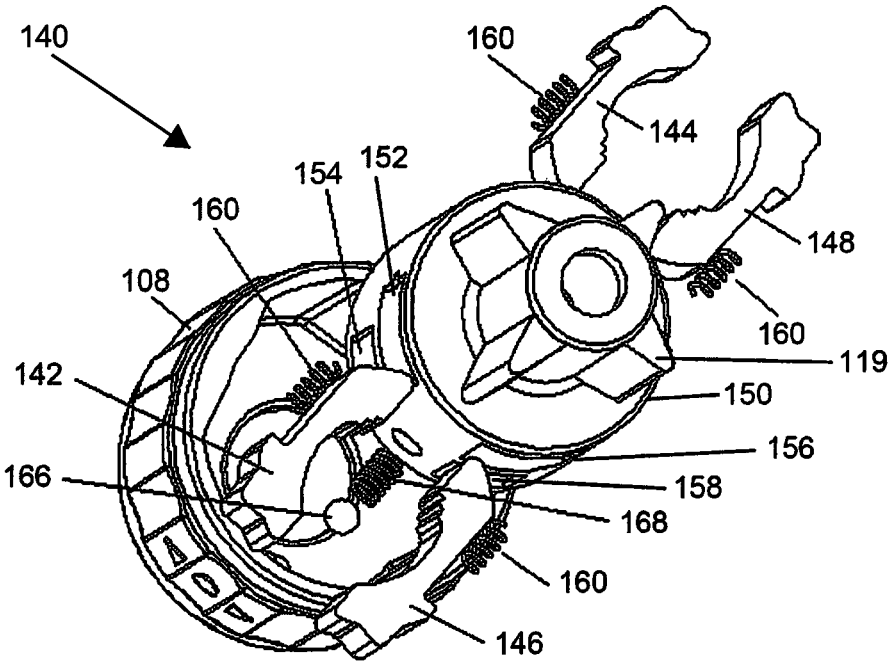
FIG. 5 shows the reversing mechanism of the ratcheting driver of FIG. 1.

The operation of transmission 112 is better understood in the context of the operation of a reversing mechanism 140 that engages transmission 112 to convert bidirectional rotation of handle 102 to unidirectional rotation of working end 106 and switch rotational direction of working end 106. FIGS. 4 and 5 show reversing mechanism 140, which includes a first ratchet gear 141 and a second ratchet gear 143. First ratchet gear 141 has a keyed inner circumference that allows it to sleeve onto and attach to shaft 114, so that the two rotate with each other. Second ratchet gear 143 has a keyed outer circumference that allows it to sleeve into and attach to second driving gear 122, so that the two rotate with each other.

In this regard, clockwise rotation of first ratchet gear 141 cause clockwise rotation of shaft 114 and a corresponding clockwise rotation of first driving gear 120 and working end 106. The clockwise rotation of first driving gear 120 translates through first primary transmission gear 124 and second primary transmission gear 126 to counter-clockwise rotation of second driving gear 122 and second ratcheting gear 143. Similarly, clockwise rotation of second ratchet gear 143 causes clockwise rotation of second driving gear 122. The clockwise rotation of second driving gear 122 translates through first primary transmission gear 124 and second primary transmission gear 126 to counter-clockwise rotation of first driving gear 120 and first ratcheting gear 141.

Reversing mechanism 140 restricts the rotation of working end 106 to a single direction. Reversing mechanism 140 includes two pairs of cooperating pawls 142, 144 and 146,148. Each pawl 142, 144, 146, and 148 in the pair of cooperating pawls 142, 144 and 146,148 are positioned axially apart from each other to engage one of first ratchet gear 141 and second ratchet gear 143 to provide selective one-way rotation of working end 106. A pawl cage 150 is provided with at least four openings 152, 154, 156, and 158 to receive one of pawls 142, 144, 146, and 148, respectively. Pawls 142 and 144 are positioned in openings 152 and 154, respectively, which are spaced on opposite sides from each other in pawl cage 150 and coaxially from each other to selectively engage first ratchet gear 141 and second ratchet gear 143, respectively. Similarly, pawls 146 and 148 are positioned in openings 156 and 158, respectively, which are spaced on opposite sides from each other of pawl cage 150 and coaxially from each other to selectively engage first ratchet gear 141 and second ratchet gear 143, respectively.

Pawls 142, 144, 146, and 148 are biased in their respective openings 152, 154, 156, and 158 by springs 160 and engage their corresponding first ratchet gear 141 and second ratchet gear 143 according to their position by switch 108. Switch 108 is effectively divided into an upper half 109 and a lower half 111 that corresponds with the first ratchet gear 141 and second ratchet gear 143, respectively, and acts upon pawls 142, 146 and pawls 144, 148, respectively. A ball 166 biased outward from pawl cage 150 by a spring 168 engages one of three detents 162, 163, and 164 (shown clearly in FIG. 12), which correspond to a clockwise, locked, and counter-clockwise selection for unidirectional rotation of working end 106. The function of reversing mechanism with switch 108 in the respective positions is described according to FIGS. 6-11.

Figure 6:
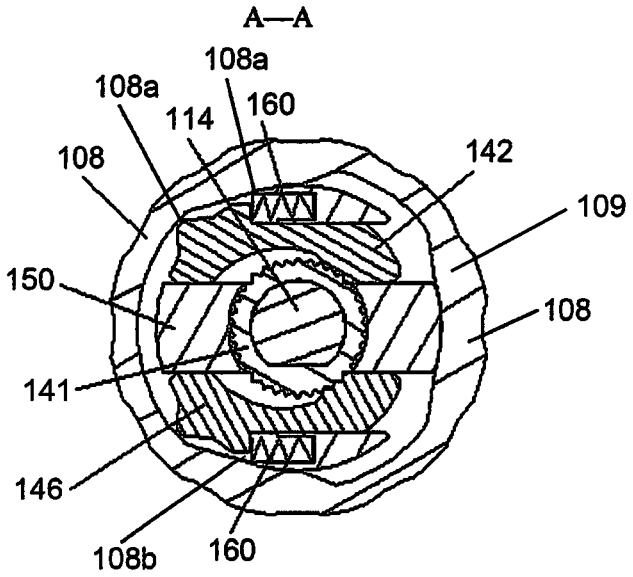
FIG. 6 shows the ratcheting driver of FIG. 1 taken along A-A with the reversing mechanism in a locked position.
Figure 7:
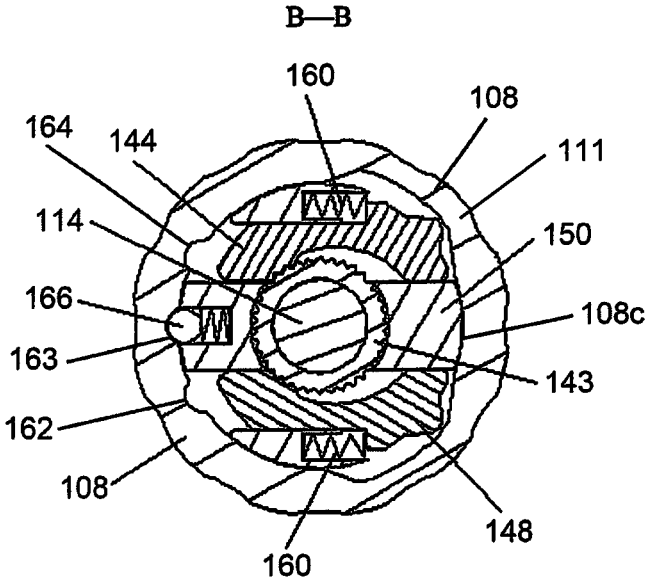
FIG. 7 shows the ratcheting driver of FIG. 1 taken along B-B with the reversing mechanism in a locked position.

FIGS. 6 and 7 show ratcheting driver 100 from the views A-A and B-B of FIG. 1, respectively, where A-A aligns with first ratcheting gear 141 and B-B aligns with second ratcheting gear 143. FIG. 7 shows switch 108 in the locked position with ball 166 engaged in detent 163. In the locked position, shaft 114 is locked in synchronous rotation with pawl cage 150 and handle 102 is locked in synchronous rotation with working end 106. The output torque on working end 106 is bidirectional (clockwise and counter-clockwise portion) as a fixed driver.

FIG. 6 shows switch 108 with area 108*a* and area 108*b* on the inner surface. Depending on the positioning of switch 108, areas 108*a* and 108*b* will urge pawl 142 and pawl 146 away from first ratchet gear 141. In FIG. 6, both area 108*a* and area 108*b* of the inner surface of switch 108 are spaced apart from the ends of pawl 142 and pawl 146, respectively, so that springs 160 can bias pawl 142 and pawl 146 into engagement with first ratchet gear 141. With both pawl 142 and pawl 146 engaged on first ratchet gear 141, first ratchet gear 141 is locked from relative rotation.

FIG. 7 similarly shows switch 108 with area 108*c* on the inner surface. Depending on the positioning of switch 108, area 108*c* will urge pawl 144 and pawl 148 away from second ratchet gear 143. In FIG. 7, area 108*c* of inner surface of switch 108 is spaced apart from the ends of pawl 144 and pawl 148, so that springs 160 can bias pawl 144 and pawl 148 into engagement with second ratchet gear 143. With both pawl 144 and pawl 148 engaged on second ratchet gear 143, second ratchet gear 143 is locked from relative rotation.

Figure 8:
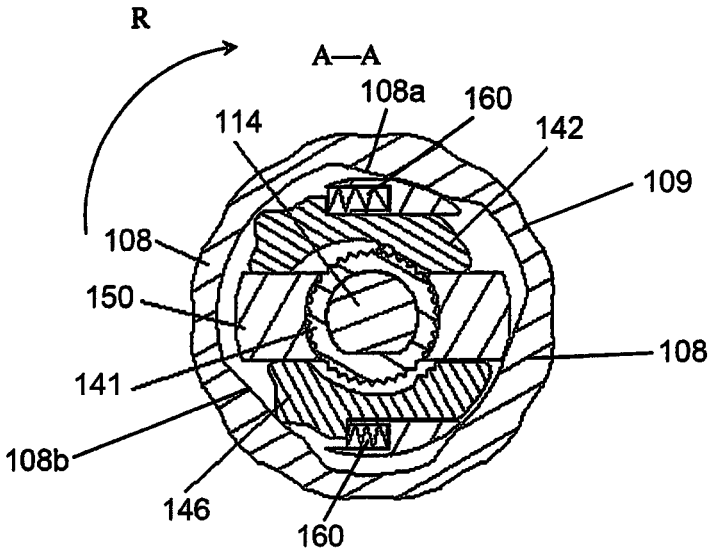
FIG. 8 shows the ratcheting driver of FIG. 1 taken along A-A with the reversing mechanism in a clockwise rotation position.

FIG. 8 shows switch 108 with area 108*b* on the inner surface rotated clockwise to engage the end of pawl 146 and urge it away from first ratchet gear 141, so that only pawl 142 is engaged with first ratchet gear 141 for unidirectional clockwise rotation of first ratchet gear 141.

Figure 9:
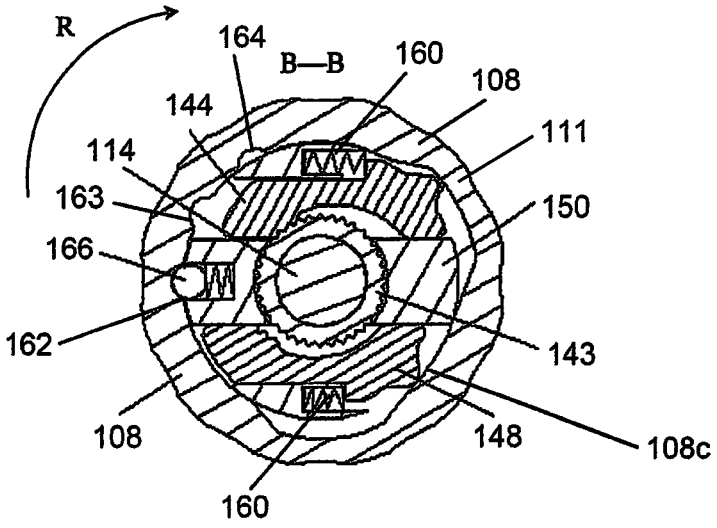
FIG. 9 shows the ratcheting driver of FIG. 1 taken along B-B with the reversing mechanism in a clockwise rotation position.

FIG. 9 shows switch with area 108*c* on the inner surface rotated clockwise to engage the end of pawl 148 and urge it away from second ratchet gear 143, so that only pawl 144 is engaged with second ratchet gear 143 for unidirectional counter-clockwise rotation of second ratchet gear 143.

Figure 10:
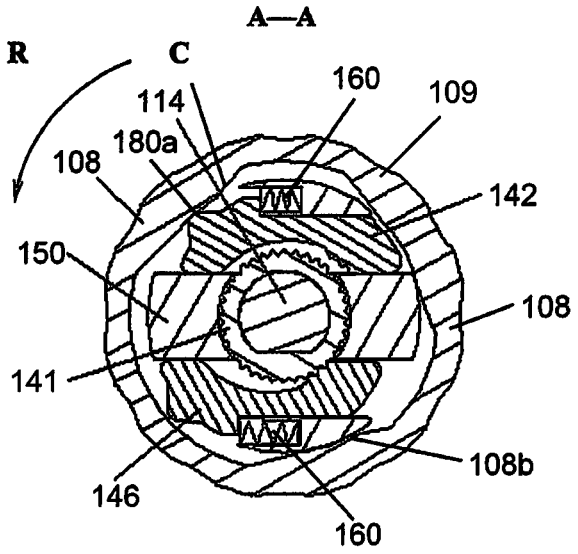
FIG. 10 shows the ratcheting driver of FIG. 1 taken along A-A with the reversing mechanism in a counter-clockwise rotation position.

FIG. 10 shows switch 108 with area 108*a* on the inner surface rotated counter-clockwise to engage the end of pawl 142 and urge it away from first ratchet gear 141, so that only pawl 146 is engaged with first ratchet gear 141 for unidirectional counter-clockwise rotation of first ratchet gear 141.

Figure 11:
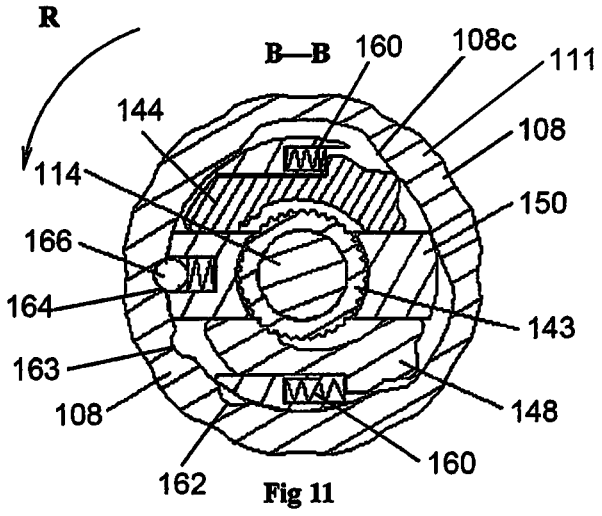
FIG. 11 shows the ratcheting driver of FIG. 1 taken along B-B with the reversing mechanism in a counter-clockwise rotation position.
Figure 12:
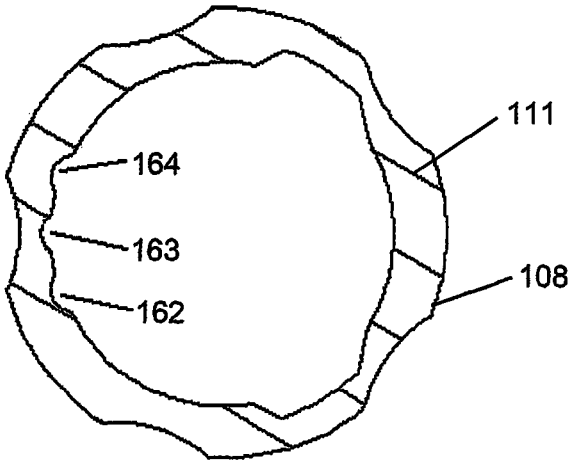
FIG. 12 shows the inner circumference of the switch.

FIG. 11 shows switch with area 108*c* on the inner surface rotated counter-clockwise to engage the end of pawl 144 and urge it away from second ratchet gear 143, so that only pawl 148 is engaged with second ratchet gear 143 for unidirectional clockwise rotation of second ratchet gear 143.

In other embodiments, the relative position of the pawls 142, 144, 146, and 148 with respect to first ratchet gear 141 and second ratchet gear 143 can be switched. While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents.

What is claimed is:

1. A ratcheting driver comprising:

a working end for acting on a work piece;

a handle positioned apart from the working end; and a transmission mechanism combined between the handle and the working end for translating a rotary motion from the handle to the working end, wherein the transmission mechanism comprises of a first driving gear and a second driving gear spaced apart from each other on an axial axis, and a first primary transmission gear coupled between the first driving gear and the second driving gear on a second axis perpendicular to the axial axis configured to counter-rotate one of the first driving gear and the second driving gear in a direction opposite of the other;

a reversing mechanism combined with the transmission mechanism for providing unidirectional rotation of the working end in one of a clockwise and counter-clockwise direction, wherein the reversing mechanism is comprised of:

a pawl cage comprising four openings;

a first ratchet gear and a second ratchet gear combined with the reversing mechanism;

a clockwise pair of cooperating pawls and a counter-clockwise pair of cooperating pawls;

wherein the clockwise pair of cooperating pawls comprises:

a first clockwise pawl which selectively engages the first ratchet gear and a second clockwise pawl which selectively engages the second ratchet gear;

wherein the clockwise pair of cooperating pawls are positioned axially apart and offset from each other with respect to the axial axis in respective openings in the pawl cage and move linearly toward and away from the axial axis in the pawl cage;

wherein engagement of the clockwise pair of cooperating pawls and disengagement of the counter-clockwise pair of cooperating pawls allows for clockwise rotation of the ratchet driver;

wherein the counter-clockwise pair of cooperating pawls comprises:

a first counter-clockwise pawl which selectively engages the first ratchet gear and a second counter-clockwise pawl which selectively engages the second ratchet gear;

wherein the counter-clockwise pair of cooperating pawls are positioned axially apart and offset from each other with respect to an axial axis in respective openings in the pawl cage and move linearly toward and away from the axial axis in the pawl cage; and wherein engagement of the counter-clockwise pair of cooperating pawls and disengagement of the clockwise pair of cooperating pawls allows for counter-clockwise rotation of the ratchet driver.

2. The ratcheting driver of claim 1, wherein the first ratchet gear and the second ratchet gear are coaxial and rotate relative to each other.

3. The ratcheting driver of claim 2, and further comprising a shaft fixed to the working end and fixed to the first ratchet gear.

4. The ratcheting driver of claim 3, wherein the second ratchet gear is positioned on the shaft to rotate relative to the shaft.

5. The ratcheting driver of claim 4, wherein the transmission mechanism provides unidirectional rotation of the working end with rotation of the handle in both a clockwise direction and a counter-clockwise direction.

6. The ratcheting driver of claim 5, wherein the second driving gear is fixed to the second ratchet gear.

7. The ratcheting driver of claim 6, wherein the first driving gear rotates synchronously with the first ratchet gear.

8. The ratcheting driver of claim 7, wherein the first primary transmission gear imparts rotation of the handle to rotation of the working end.

9. The ratcheting driver of claim 8, and further comprising a gear rack for positioning the first driving gear, the second driving gear and the first primary transmission gear relative to each other.

10. The ratcheting driver of claim 9, and further comprising a second primary transmission gear positioned axially apart from the first primary transmission gear on the second axis.

11. The ratcheting driver of claim 1, wherein the mechanism further comprises:

a switch for selectively engaging the clockwise pair of cooperating pawls and the counter-clockwise pair of cooperating pawls;

wherein the switch has an upper half and a lower half;

wherein at a first position the upper half of the switch selectively engages the first clockwise pawl into engagement with the first ratchet gear and the lower half of the switch selectively engages the second clockwise pawl into engagement with the second ratchet gear; and wherein at a second position the upper half of the switch selectively engages the first counter-clockwise pawl into engagement with the first ratchet gear and the lower half of the switch selectively engages the second counter-clockwise pawl into engagement with the second ratchet gear.

12. The ratcheting driver of claim 11, wherein one of the upper half and the lower half of the switch comprises at least two detents on an inner circumference in order to resistively maintain the switch in one of two positions corresponding with a clock wise rotation of the working end and a counter clockwise rotation of the working end.

13. The ratcheting driver of claim 12, wherein each of the upper half of the switch and the lower half of the switch has an area on the inner circumference of the switch that selectively urges a pawl of the clockwise pair of cooperating pawls or the counter-clockwise pair of cooperating pawls away from the corresponding first ratchet gear and the second ratchet gear.

14. A ratcheting driver comprising:

a working end for acting on a work piece;

a handle positioned apart from the working end; and a transmission mechanism combined between the handle and the working end for translating a rotary motion from the handle to the working end, wherein the transmission mechanism comprises of a first driving gear and a second driving gear spaced apart from each other on an axial axis, and a first primary transmission gear coupled between the first driving gear and the second driving gear on a second axis perpendicular to the axial axis configured to counter-rotate one of the first driving gear and the second driving gear in a direction opposite of the other;

a switch engaging the transmission mechanism for switching a rotational direction of the working end between a clockwise rotation and a counter-clockwise rotation;

a first ratchet gear and a second ratchet gear;

a pawl cage comprising four openings;

a clockwise pair of cooperating pawls and a counter-clockwise pair of cooperating pawls;

wherein the clockwise pair of cooperating pawls comprises:

a first clockwise pawl which selectively engages the first ratchet gear and a second clockwise pawl which selectively engages the second ratchet gear;

wherein the clockwise pair of cooperating pawls are positioned axially apart and offset from each other with respect to an axial axis in respective openings in the pawl cage and move linearly toward and away from the axial axis in the pawl cage;

wherein engagement of the clockwise pair of cooperating pawls and disengagement of the counter-clockwise pair of cooperating pawls allows for clockwise rotation of the ratchet driver;

wherein the counter-clockwise pair of cooperating pawls comprises:

a first counter-clockwise pawl which selectively engages the first ratchet gear and a second counter-clockwise pawl which selectively engages the second ratchet gear;

wherein the counter-clockwise pair of cooperating pawls are positioned axially apart and offset from each other with respect to an axial axis in respective openings in the pawl cage and move linearly toward and away from the axial axis in the pawl cage; and wherein engagement of the counter-clockwise pair of cooperating pawls and disengagement of the clockwise pair of cooperating pawls allows for counter-clockwise rotation of the ratchet driver.

15. The ratcheting driver of claim 14, wherein the switch further comprises an upper half and a lower half;

wherein at a first position the upper half of the switch selectively engages the first clockwise pawl into engagement with the first ratchet gear and the lower half of the switch selectively engages the second clockwise pawl into engagement with the second ratchet gear; and wherein at a second position the upper half of the switch selectively engages the first counter-clockwise pawl into engagement with the first ratchet gear and the lower half of the switch selectively engages the second counter-clockwise pawl into engagement with the second ratchet gear.

16. The ratcheting driver of claim 15, wherein one of the upper half and the lower half of the switch comprises at least two detents for on an inner circumference in order to resistively maintain the switch in one of two positions corresponding with a clock wise rotation of the working end and a counter-clockwise rotation of the working end.

17. The ratcheting driver of claim 16, wherein the at least two detents are on the lower half of the switch, the lower half of the switch has an area on the inner circumference of the switch that selectively engages the second clockwise pawl or the second counter-clockwise pawl to urge the pawl away from the second ratchet gear so that only one pawl is engaged with the second ratchet gear at a time corresponding with a clock wise rotation of the working end and a counter-clockwise rotation of the working end.

18. The ratcheting driver of claim 17, wherein the lower half of the switch comprises three detents with one of the three detents corresponding with a locked position that locks the working end.

* * * * *